United States Patent [19]

Ahlers

[11] Patent Number: 4,754,707

[45] Date of Patent: Jul. 5, 1988

[54] PROJECTILE

[75] Inventor: Utz U. Ahlers, Schnaittach, Fed. Rep. of Germany

[73] Assignee: Diehl GmbH & Company, Nuremberg, Fed. Rep. of Germany

[21] Appl. No.: 908,107

[22] Filed: Sep. 16, 1986

[51] Int. Cl.[4] ..... F42B 31/00

[52] U.S. Cl. ..... 102/527; 102/524

[58] Field of Search ..... 102/524–527, 102/520–523

[56] References Cited

U.S. PATENT DOCUMENTS

| | | | |
|---|---|---|---|
| 2,809,587 | 10/1957 | Musser . | |
| 2,928,348 | 3/1960 | Zisman et al. | 102/527 |
| 3,738,279 | 6/1973 | Eyre et al. | 102/703 |
| 3,834,314 | 9/1974 | Young | 102/703 |
| 4,109,582 | 8/1978 | Halp et al. | 102/526 |
| 4,242,961 | 1/1981 | Moredock et al. | 102/527 |
| 4,366,015 | 12/1982 | Murray | 102/527 |
| 4,520,731 | 6/1985 | Gotz et al. | 102/527 |
| 4,552,071 | 11/1985 | Horais | 102/527 |

FOREIGN PATENT DOCUMENTS

| | | |
|---|---|---|
| 42457 | 6/1980 | European Pat. Off. . |
| 27552 | 9/1980 | European Pat. Off. . |
| 2924217 | 6/1986 | Fed. Rep. of Germany . |
| 3510913 | 7/1987 | Fed. Rep. of Germany . |
| 1093020 | 4/1952 | France . |
| 735012 | 8/1955 | United Kingdom . |
| 2132321 | 12/1983 | United Kingdom . |
| 2148462 | 9/1984 | United Kingdom . |

*Primary Examiner*—Harold Tudor

*Attorney, Agent, or Firm*—Scully, Scott, Murphy & Presser

[57] ABSTRACT

A projectile which is fireable in a spin-stabilized manner from a weapon barrel or launch tube through the action of the gas pressure generated by a propellant charge, and which projectile is guidable during flight. The projectile is equipped in the rearward region of its tail-end structure, and preferably behind the control surfaces, with a type of propulsion cage so as to, through the intermediary of the gas pressure generated by the propellant charge, faciliate a ballistic firing of the projectile from a weapon barrel or launch tube. The projectile is equipped with a sealing ring, which with a gliding frictional contact, coaxially encompasses an axially-limited region of the tail-end structure of the projectile.

8 Claims, 1 Drawing Sheet

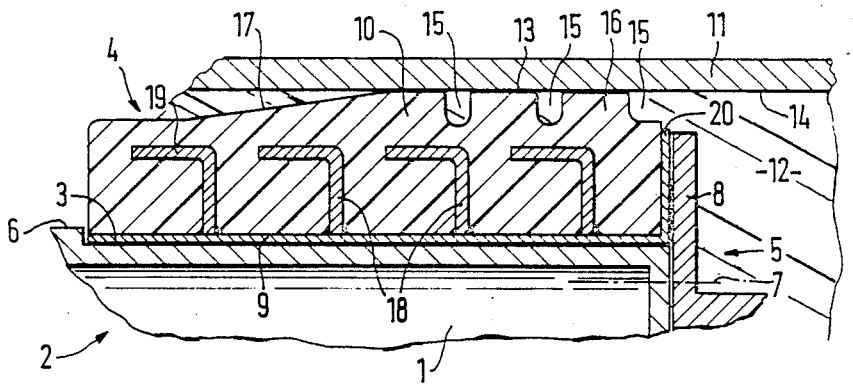
17
10
15
13
15
16
15
11
4
19
20
14
-12-
3
8
6
5
7
9
18
2
1

PROJECTILE

BACKGROUND OF THE INVENTION

1. Field of the Invention

The present invention relates to a projectile which is fireable in a spin-stabilized manner from a weapon barrel or launch tube through the action of the gas pressure generated by a propellant charge, and which projectile is guidable during flight.

2. Discussion of the Prior Art

A projectile of this type has become known from the disclosure of German Pat. No. 30 26 409. In order to increase the flying range of the projectile, in comparison with a purely ballistic trajectory, the rearward portion of the projectile body or fuselage is equipped with sliding surfaces. Also, the tail-end structure of the projectile carries control surfaces or fins for guiding the projectile towards a target. While the projectile is stored or retained in a magazine, and when the projectile is loaded into a weapon barrel or launch tube, the above-mentioned sliding surfaces (which are over-caliber sized in this operational position) are folded into the projectile body, and the (similarly over-caliber sized) control surfaces are retracted against or into the tail-end structure of the projectile.

SUMMARY OF THE INVENTION

Accordingly, it is an object of the present invention to equip a projectile, of the type under consideration, in the rearward region of its tail-end structure, and preferably behind the control surfaces, with a type of propulsion cage so as to facilitate a ballistic firing of the projectile from a weapon barrel or launch tube through the intermediary of the gas pressure generated by the propellant charge. Hereby, on the one hand, the initial spin of the projectile should not be greater than that required to stabilize the projectile at the beginning of its trajectory, inasmuch as the outward unfolding of the glide surfaces should occur as soon as possible after the projectile reaches a ballistically stable, initial trajectory. However, the outward unfolding of the control surfaces can be disturbed by an excessively high rate of projectile spin because of the centrifugal forces and the tangential oncoming airflow against the projectile. On the one other hand, an ordinary weapon barrel (preferred in the interest of standardizatiion) is equipped with a drag field profile, which would lead to an unnecessary or even damagingly intense initial spin of the projectile.

When, in contrast therewith, upon firing, a propulsion cage is rotated within the barrel relative to the projectile, then the spin of the projectile is lower than the spin of the cage which is generated by the drag-field profile in the weapon barrel. However, there must be hereby ensured that, especially the starting conditions at the discharge from the weapon barrel will not lead to a mechanical destruction of the propulsion cage. This is so because (in contrast to the firing of a projectile from the cannon of an armored vehicle) the service personnel for a weapon, of the type under consideration herein, would not be adequately protected from from a propulsion cage which disintegrates immediately in front of the weapon barrel.

In recognition of these conditions, consequently it is an object of this invention to provide a projectile, of the type under consideration, which meets the indicated requirements. This object is inventively achieved in that the projectile of the type under consideration is equipped with a sealing ring that coaxially encompasses, and is in a sliding frictional engagement with, an axially-limited region of the tail-end structure of the projectile.

The cylindrical frictional sliding engagement between surfaces of the tail-end structure of the projectile and the sealing ring surrounding the former can be designed as a paired material arrangement at the cooperating cylindrical surfaces, and which has the capacity to withstand optimal mechanical and thermal stresses.

To obtain the sealing effect within the barrel; for example, as the caliber changes, a sliding ring which extends about the tail-end structure of the projectile is expediently molded about or sprayed with a plastic material, and the material property of the plastic is selected for an optimum strength with respect to the thermal and mechanical stresses encountered during the sealing of the gas pressure chamber for the propellant charge. In the interest of obtaining a low degree of wear on the inner wall of the barrel, and also a high strength of the barrel and the sealing properties with respect to the gas pressure, as well as the mechanical torsional load transmission, it is advantageous to employ a fiber-reinforced plastic material. Flange-shaped inserts in the plastic material of the sealing ring, which are fastened to its sliding or glide ring, and which are manufactured from a mechanically stiffer material than the plastic material component (serving for caliber-bridging and for the sealing of the propellant gas), may be provided to increase the surface available for the adhesion of the plastic material to the sliding ring, as well as for the stiffening of the plastic member in the firing direction. An especially high degree of assurance against the radial scattering of portions of the plastic material members upon the exit from the weapon barrel is achieved when these flange inserts extend in parallel at an angle relative to the longitudinal extent of the projectile.

BRIEF DESCRIPTION OF THE DRAWINGS

Additional alternatives and modifications, as well as further features and advantages of the invention, may now be readily ascertained from the following detailed description of an exemplary embodiment thereof, taken in conjunction with the single FIGURE of the drawing which illustrates, in a fragmentary longitudinal sectional view, a portion of the tail-end structure of a projectile with an encompassing sealing ring thereon.

DETAILED DESCRIPTION

An axially limited, cylindrical section of the tail-end structure 1 of a projectile 2 mounts a sealing ring 4 on its casing surface 3 in a sliding fit therewith. In the illustrated exemplary embodiment, the forward axial limit of ring 4, in the direction of the firing accelerating 5, is determined by a radically projecting surrounding shoulder 6, and the back axial limit of the ring is determined by means of a thrust plate 8. Plate 8 is fastened, for example, through a screw connection 7 to the tail end structure 1, and plate 8 also projects radially beyond the casing surface 3.

The sealing ring 4 rests with its sliding ring 9 on the casing surface 3 of the projectile tail-end structure. The sliding ring 9 is heavily sprayed with a heat-resistant and wear-resistant plastic material member 10, which in the type of propulsion cage, bridges over the radial distance between the tail-end structure 1 and the drag-field profile on the inner wall 14 of a weapon barrel or launch tube 11. In consequence thereof, a gas pressure in a chamber 12 formed by a propellant charge in the barrel 11 is sealed off, with respect to the forward direction, behind the sealing ring 4. Thus, the projectile 2 is accelerated in the firing direction 5 and thereby can be fired out of the launch tube or barrel 11 in a known manner through the burning of a propellant medium or the initiation of another propellant gas reaction.

During the advance of the projectile through the launch tube or barrel 11, the guiding casing surface 13 of the sealing ring 4 cuts somewhat into the drag-field profile of the inner wall 14 of the barrel such that, through the frictional contact of its sliding ring 9 against the casing surface 3 of the tail-end structure, the projectile 2 is also set into rotation. However, due to the rotational sliding movement between the gliding ring 4 and the tail-end structure 1 of the projectile, the spin which is developed by the projectile 2 as it is fired from the barrel 11, is noticeably lower than the spin which is exerted by the inner drag of the barrel directly against the sealing ring 4 itself.

In the interest of obtaining an effective sealing and a close fitting engagement of the casing surface 13 of the sealing ring into the profile of the inner wall 14 of the barrel, the casing surface 13 is not continually cylindrically. Rather, as can be ascertained from the drawing, surface 13 is profiled through axially mutually displaced annular grooves 15, between which there are, as a result, annular ridges 16. For kinetic reasons, the forward region of the sealing ring 4 extends inwardly, in cross-section, somewhat angled; in effect, the forward portion of ring 4 has a frusto-conical shape.

The sliding ring 9 is constituted of a mechanically and thermally highly stressable material, in particular, from a metallic material which, for example, has alloy materials fused into the outer surface thereof, and which possess good frictional properties. Rearwardly, opposite the acceleration in the direction of firing 5, the plastic member 10 is restricted by flange-like, annular disc-shaped like supporting wall 20, which is fastened or formed with the sliding ring, and which produces the frictional pairing of materials with respect to the rearward thrust plate that is fixed to the projectile structure. Radially projecting flanges 18 are fastened to sliding ring 9; and during the thrust and torsional loadings upon acceleration within the barrel 11, as well as during the intense pressure drop-off at the momement of the exit from the barrel 11, flanges 18 insure that, first, the frictional load actually only takes place between the applicable portion of the casing surface 3 of the tail-end structure and the sliding ring 9 which is coaxially guided thereon, and second, that a fixed connection is maintained between the sliding ring 9 and the plastic material member 10 which is sprayed about its outer periphery.

These flanges can be constituted of metal, or of fiber reinforced plastic materials, and shaped as spoke-like rods or encompassing rings. Because of the increase in the surface between, on the one hand, the sliding ring 9 (with the flanges 18 fastened thereon), and on the other hand, the sprayed-about plastic material member 10, there is afforded an extremely secure, wear-resistant and shear-resistant adhesion. Moreover, such flanges 18 provide a form-fitted connection between the plastic material member 10 and the sliding ring 9, which counteracts any tendency for relative axial and, occasionally, radial movement between the two components.

As can be ascertained from the drawing, the flanges 18 at their free ends which project from the sliding ring 9, extend as angled members 19; basically in parallel angled somewhat relative to the casing surface 3 of the projectile tail-end structure. Members 19 particularly insure that the extremely intense radial forces encountered at the instance of exit from the muzzle of the barrel 11, will not cause portions of the plastic material member 10 to tear away radially from sliding ring 9, which with respect to the sealing ring 4 rotating relative to the projectile 2, remains ballistically secured; namely held solidly together, after leaving the barrel 11. As shown in the drawing, angled members 19 are bent forwardly, in effect, from the flanges 18 into the firing direction 5, then this provides the further constructive advantage that the axial thrust on the plastic material 10 relative to the tail-end structure 1 of the projectile, exerted thereon by the inner wall of the barrel 14 opposite the firing direction 5. This counters a tendency of the flanges 18 to bend in the direction opposite that of firing, and thereby leads to a slight extension of the forward free ends of the angled members 19 in a direction towards the inner wall 14 of the barrel. In effect, this increases the radial compressive force of the plastic material member 10 (radially supported against its sliding ring 9) in the drag-field profile; and as a result of this, there is additionally counteracted any slipping through the casing surface 13 of the sealing ring relative to the inner wall 14 of the barrel, or any leakage of propellant gas pressure.

What is claimed is:

1. A spin-stabilized guided projectile for use with a firing barrel, the projectile comprising;

a tail end portion including an axially extending outside surface;

a sealing ring mounted on said outside surface, and including (i) a sliding ring circumferentially extending around said outside surface and in sliding frictional contact therewith, said sliding ring being supported by said outside surface along an axially limited region thereof for circumferential sliding movement to impart to the projectile a spin which is less than the spin imparted to the sealing ring by the firing barrel, (ii) a heat and friction resistant plastic material applied on the sliding ring and secured thereto for circumferential sliding movement with the sliding ring, the plastic material extending radially outward from the sliding ring to engage the firing barrel and to form a gas seal therewith, (iii) a plurality of bendable flanges connected to and radially extending outward from the sliding ring, said flanges extending into and being stiffer than the plastic material, each of said radially extending and bendable flanges including an angled end member extending substantially parallel to the longitudinal axis of the projectile and terminating in a terminal free end extending in the direction of firing of the projectile such that the axial thrust exerted on the plastic material by the inner wall of the firing barrel during firing causes the flanges and angled end members to bend opposite to the direction of firing to cause a slight extension of the terminal free ends of the angled end members to increase the radial compressive force of the plastic material against the inner wall of the firing barrel to counteract any slippage therebetween and to provide a more effective propellant gas seal.

2. Projectile as claimed in claim 1, wherein said plastic material comprises a fiber-reinforced material.

3. A projectile as claimed in claim 1, wherein a rearward end of said sliding ring forms a transition into a radially projecting supporting wall.

4. A projectile as claimed in claim 1, wherein the sliding ring is made of a metallic material.

5. A projectile as claimed in claim 1, comprising a thrust plate fastened to the tail end portion of said projectile, said thrust plate limiting rearward movement of said sealing ring along the outside surface of the tail end portion of the projectile.

6. A projectile as claimed in claim 1, wherein said plastic material includes a casing surface having a grooved profile.

7. Projectile as claimed in claim 1, wherein said sealing ring has a frusto-conically reducing geometry towards the firing direction of said projectile.

8. A projectile according to claim 1, wherein:

the plastic material includes (i) an outside annular surface, (ii) a plurality of annular grooves radially extending inward from the outside surface of the plastic material, and (iii) inside annular surfaces forming radially inside bottoms of the annular grooves; and the bottoms of the annular grooves are radially located outside the flanges.

* * * * *